US005452478A

United States Patent [19]

Rombach et al.

[11] Patent Number: 5,452,478

[45] Date of Patent: Sep. 26, 1995

[54] GARDENING GLOVE

[76] Inventors: Donna M. Rombach; Peter A. Rombach, both of 4626 Park Dr. South, Metairie, La. 70001

[21] Appl. No.: 319,013

[22] Filed: Oct. 6, 1994

[51] Int. Cl.[6] ..... A41D 19/00

[52] U.S. Cl. ..... 2/161.6; 2/159; 2/166

[58] Field of Search ..... 2/159, 161.6, 166, 2/160, 161.1, 162

[56] References Cited

U.S. PATENT DOCUMENTS 4,149,601 4/1979 Taylor ..... 2/161.6 X 5,088,123 2/1992 MacDonald ..... 2/162

5,093,933 3/1992 Berry ..... 2/161.6

*Primary Examiner*—C. D. Crowder

*Assistant Examiner*—Shirra L. Jenkins

[57] ABSTRACT

A semi-long sleeved gardening glove is disclosed constructed with unique rib stiffeners built into the sleeve to stiffen the sleeve and prevent it from slipping down the forearm. A loop pile or other fastener forms a snug fit at the top to prevent insects or debris from entering the glove. An anti-slip material beneath the fastener further inhibits slippage down the forearm and helps form a snug fit against the wearer's forearm.

1 Claim, 4 Drawing Sheets

GARDENING GLOVE

BACKGROUND OF THE INVENTION

The invention relates to gardening gloves, which are designed to protect the gardener's hands as he works in the garden.

It is well known that a gardener while working in the garden comes into contact with an almost limitless variety of insects. Some of these insects can deliver bites or stings that are quite painful. Some people have allergic reactions and have to be hospitalized. Some stings and bites have been known to kill people or cause diseases.

The gardener is also exposed to the harmful ultraviolet rays of the sun, which can cause premature aging and cancer of the skin. The gardener also in the course of work encounters thorns, stickers, poisonous plants and sharp twigs and branches which can cause painful swelling, allergic reactions, cuts, scrapes and scratches.

Current forms of gardening gloves are short and barely cover the wrist, rather loose fitting and offer little or no protection to the gardener (see e.g., U.S. Pat. No. 2,018,442 Work Glove).

The Prior Art generally deals with specific work gloves for specific uses, e.g., Electrical Insulation Glove, U.S. Pat. No. 2,886,824, Corn Husker's Glove, U.S. Pat. No. 436,206, Policeman's Glove, U.S. Pat. No. 3,108,285, Welding Glove, U.S. Pat. No. 2,448,697, Baby Washing Glove, U.S. Pat. No. 4,330,887, Bricklayer's glove. U.S. Pat. No. 945, 818.

The only patented Garden Glove found is U.S. Pat. No. 3,593,803, which is a short sleeved glove designed with a built in tool for digging, with metal blades protruding from the fingers. None of the gloves addressed the true needs of the garden worker who needs protection for his hands and forearms from insects, poisonous plants, sun, dirt, debris, scrapes and scratches. Thus, a need exists for an improved design garden glove that alleviates the above problems.

SUMMARY OF THE INVETNION

The present invention provides a light weight durable glove that protects both hand and forearm from insects, poisonous plants, sun, dirt, debris, scrapes and scratches.

This invention accomplishes this as the glove has hand and sleeve portions that covers the forearm up to but just below the elbow. This allows a full range of movement for the elbow and arm. The sleeve is prevented from slipping down the forearm by a plurality of long, slender, rigid plastic or metal rib stiffeners, which are structured into the sleeve to support it.

At the proximal end of the glove a fastening strap with hook and loop closure elements snugs the glove against the arm preventing any insects or objects from entering the glove. A non-slip fabric extending the circumference of the inner surface of the fastening strap also aids in preventing the sleeve from slipping down the forearm. The glove is comfortable as it is made from a light weight but durable material. It is also white or very light in color so the gardener can readily spot any insects crawling on the glove and take appropriate action.

DETAILED DESCRIPTION OF THE DRAWINGS

Figure 1:
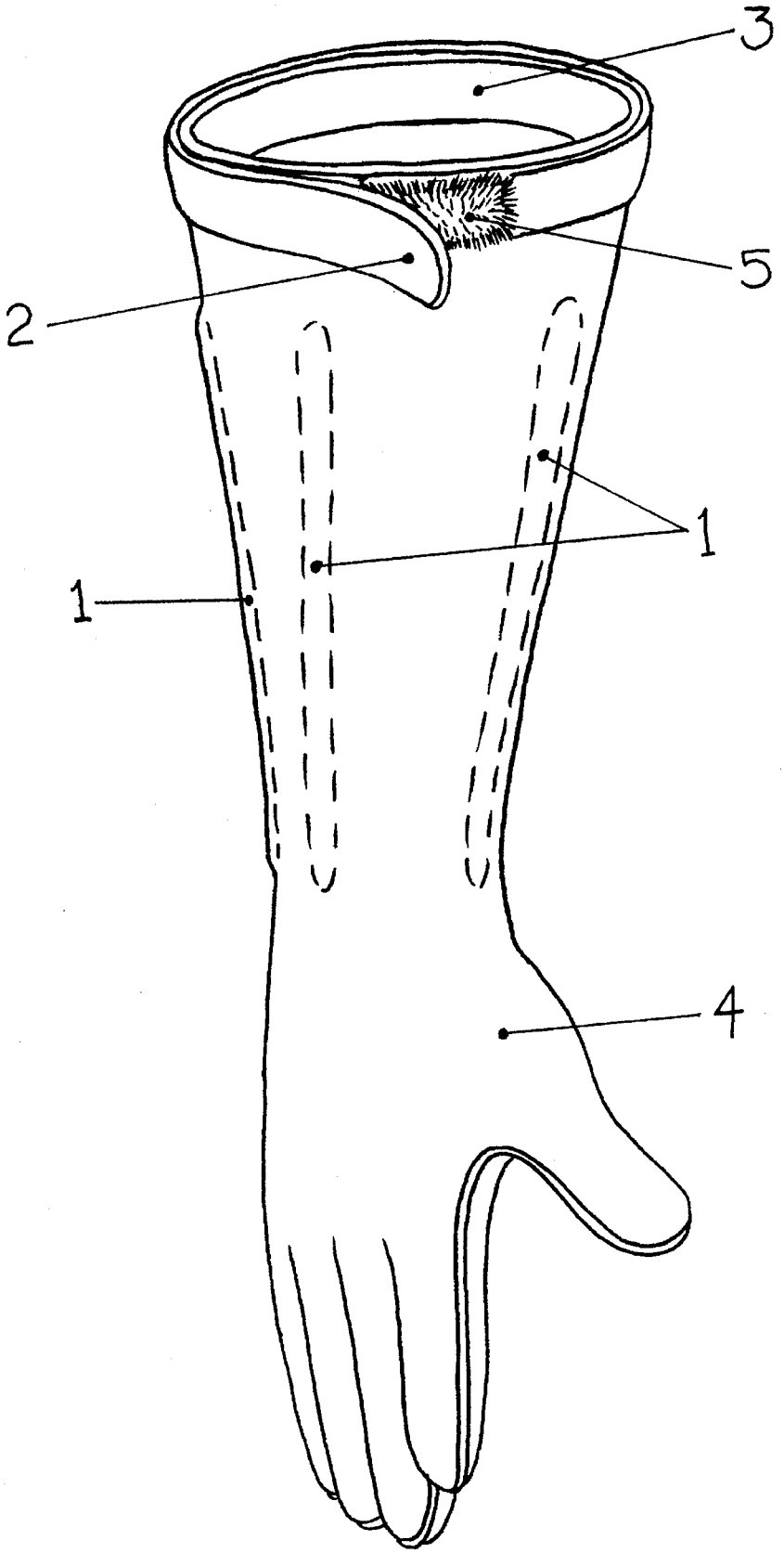
FIG. 1 is a view of the gardening glove.

The present invention is shown in frontal view in FIG. 1. The basic fabric of the glove 4 is white or very light in color. The basic fabric 4 is light in weight but tough and durable. The sleeve portion of the glove is prevented from collapsing by unique rib stiffeners 1. These are sewn into the basic fabric 4 running length-wise with the sleeve portion starting about one inch below the fastening strap 2 and ending one inch above the hand portion. At the top of the glove is the fastening strap 2 which in this illustration has a loop and pile closure element(s). A short band of an anti-slip material 3 which circumferentially underlies the fastening strap also aids the glove from slipping down the wearer's forearm. Fastening strap 2 forms a snug fit against wearer's forearm.

Figure 2:
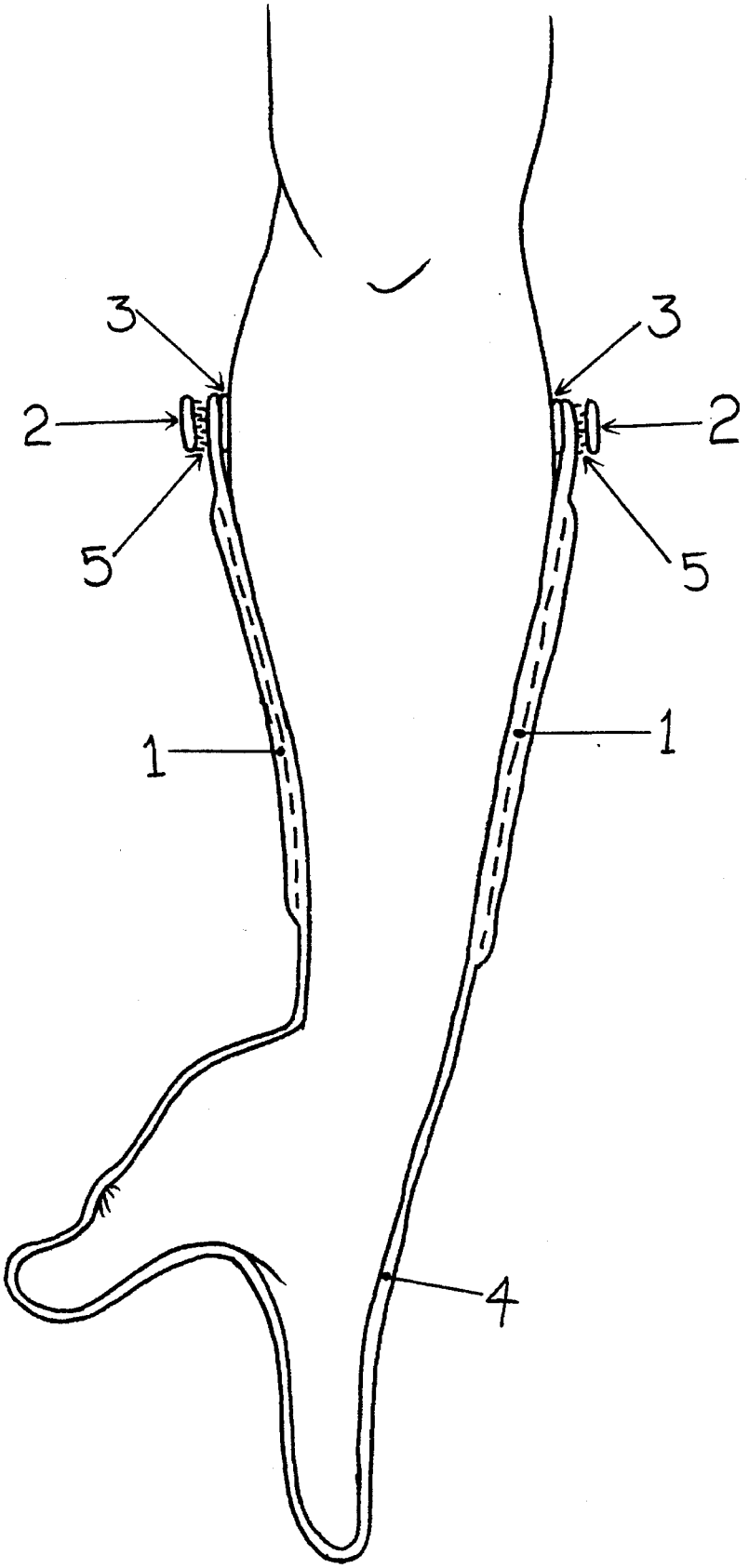
FIG. 2 is a cross sectional view with person wearing the glove.

FIG. 2 is a cross sectional view with a person wearing the glove showing the fitting of the anti-slip material 3 contacting the forearm next to the skin and beneath the fastening strap 2. The unique rib-stiffeners 1 sewn into the basic fabric 4 run the length of the sleeve portion starting one inch below fastening strap 2 and stopping about one inch above the hand portion.

Figure 4A:
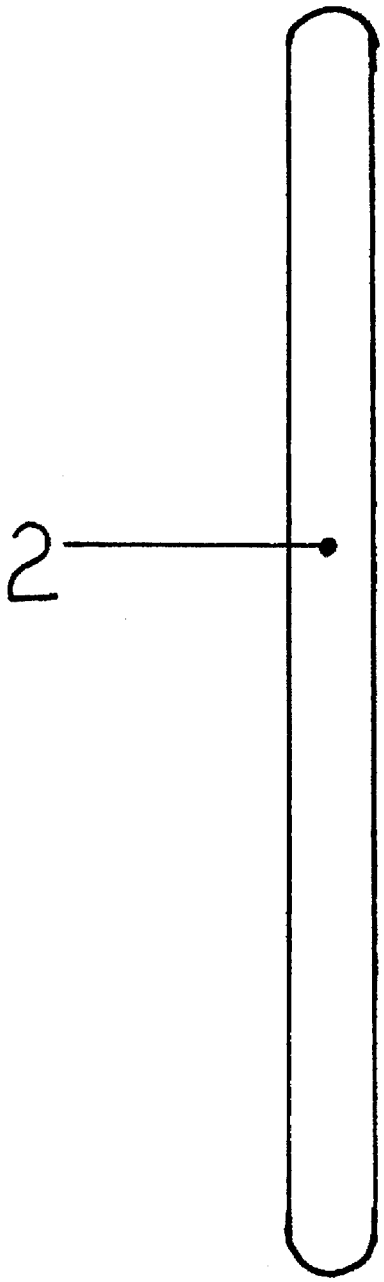
FIG. 4*a* is a front view of a type of plastic fastener.
Figure 4B:
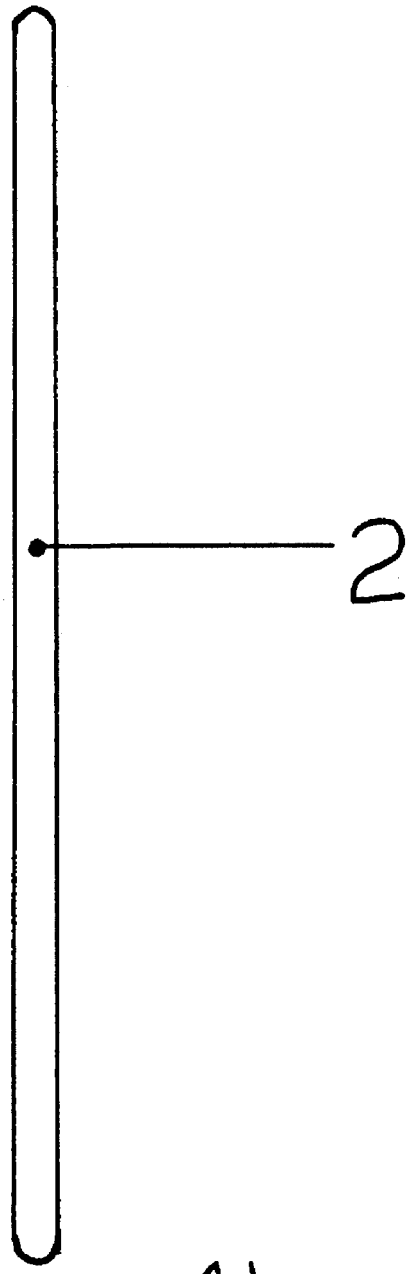
FIG. 4*b* is a side view of a type of plastic fastener
Figure 4C:
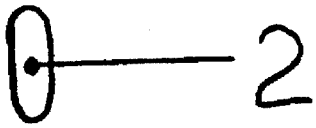
FIG. 4*c* is a top view of a type of plastic fastener

FIGS. 4A–4C shows a type of rib-stiffener 1 made of plastic. All ends are rounded to prevent the rib-stiffener 1 from cutting into the basic fabric 4.

Figure 3:
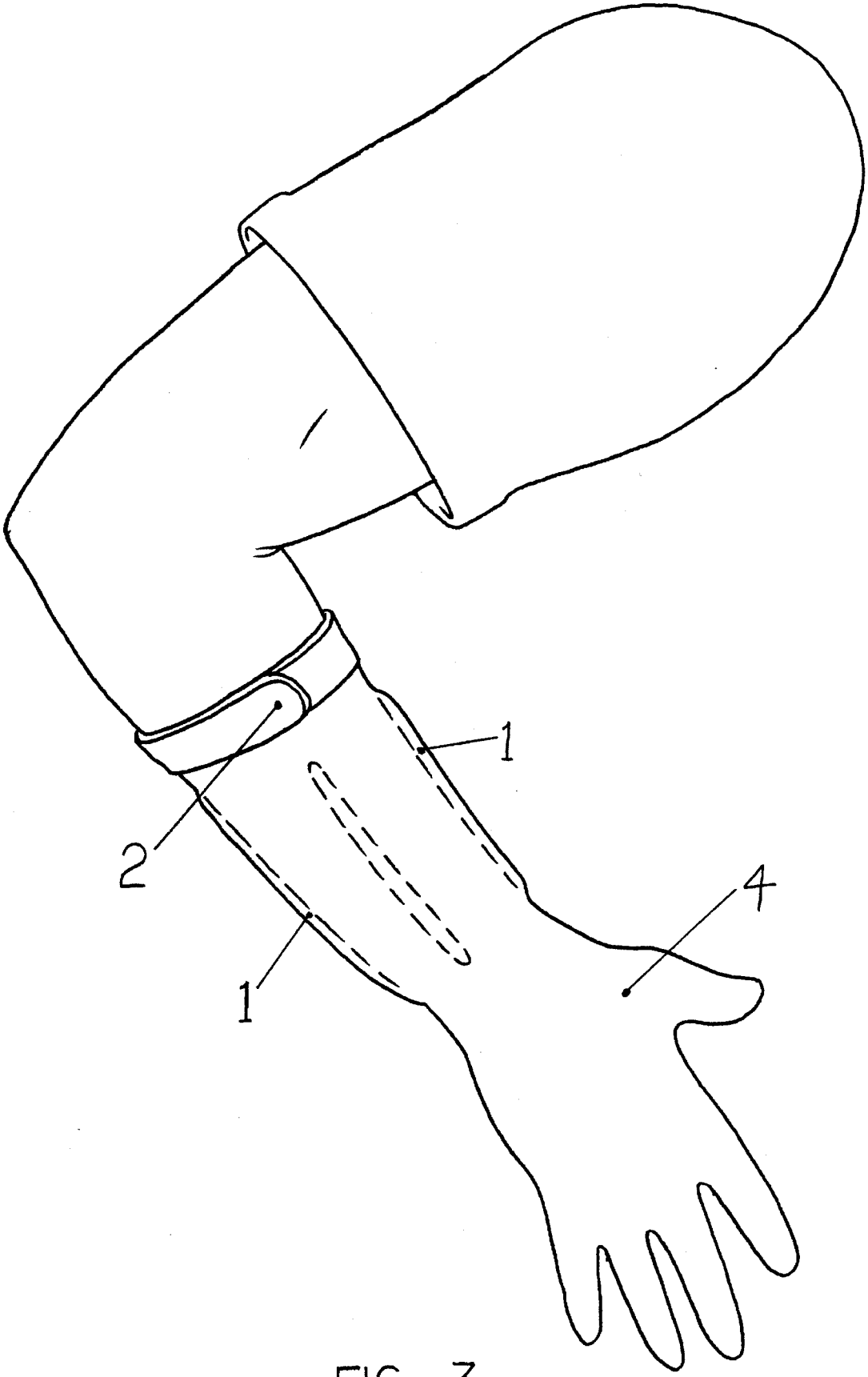
FIG. 3 is a view of a glove as it may be worn.

FIG. 3 shows the glove as it may be worn by the user.

The foregoing description has been for the purpose of illustration. Thus, a number of modifications, changes and substitutions in the form and details may be made without departing from the spirit and scope of the present invention.

We claim:

1. A gardening glove made of light colored, durable fabric comprising:

a hand portion;

a sleeve portion that extends from said hand portion to just below the elbow of the wearer;

a fastening strap attached to the proximal end of said sleeve portion;

said fastening strap having cooperating hook and loop closure elements, and anti-slip material extending about the circumference of the inner surface of said fastening strap;

said sleeve portion having a plurality of long, slender, rigid stiffeners;

said stiffeners having rounded ends and extending along the length of said sleeve portion about one inch below said fastening strap to about one inch from said hand portion.

* * * * *